US006981482B2

(12) United States Patent
Tsunoda et al.

(10) Patent No.: US 6,981,482 B2
(45) Date of Patent: Jan. 3, 2006

(54) RECOIL STARTER

(75) Inventors: Shuhei Tsunoda, Tokyo (JP); Isao Tohyama, Tokyo (JP); Toshinori Morishige, Tokyo (JP)

(73) Assignee: Starting Industrial Co., Ltd, Tokyo (JP)

( * ) Notice: Subject to any disclaimer, the term of this patent is extended or adjusted under 35 U.S.C. 154(b) by 0 days.

(21) Appl. No.: 10/643,822

(22) Filed: Aug. 19, 2003

(65) Prior Publication Data

US 2004/0123827 A1 Jul. 1, 2004

(30) Foreign Application Priority Data

Aug. 29, 2002 (JP) ..... 2002-250245
Aug. 29, 2002 (JP) ..... 2002-250246

(51) Int. Cl.
*F02N 3/02* (2006.01)

(52) U.S. Cl. ..... 123/185.3; 74/7 C

(58) Field of Classification Search ..... 123/185.14, 123/185.2, 185.3, 185.4; 185/41 A, 45
See application file for complete search history.

(56) References Cited

U.S. PATENT DOCUMENTS

| | | | | |
|---|---|---|---|---|
| 5,287,832 | A | 2/1994 | Uhl | 123/185.3 |
| 6,588,390 | B2 | 7/2003 | Kawasaki et al. | 123/185.3 |
| 2001/0047786 | A1 * | 12/2001 | Kawasaki et al. | 123/185.3 |
| 2003/0213455 | A1 | 11/2003 | Tohyama | 123/185.3 |

FOREIGN PATENT DOCUMENTS

JP 2003-336568 11/2003

* cited by examiner

*Primary Examiner*—Andrew M. Dolinar

(57) ABSTRACT

A recoil starter having improved durability by inhibiting excessive deformation of a damper spring, and capable of receiving a damper spring with high shock-absorbing and force-storing capabilities. The recoil starter includes a rope reel and a cam which are rotated by pulling a recoil rope, so that a rotation of the cam is transmitted to an engine via a ratchet mechanism to start the engine. A damper spring which couples the rope reel and the cam to each other has, at opposite ends thereof, engaging portions radially movably supported by holding portions of the rope reel and the cam, respectively, so that substantially the overall length of the damper spring winds and tightens uniformly around outer peripheral surfaces of both bosses of the rope reel and the cam due to a startup resistance of the engine.

16 Claims, 7 Drawing Sheets

RECOIL STARTER

BACKGROUND OF THE INVENTION

1. Field of the Invention

The present invention relates to a recoil starter having a recoil rope wound around a rope reel, wherein one end of the recoil rope drawn outside a casing of the recoil starter is pulled to rotate the rope reel so that a rotational force of the rope reel is transmitted to a cam via a damper spring, and then a rotation of the cam is transmitted to a rotational member coupled to a crankshaft of an engine via a ratchet mechanism to rotate the rotational member, whereby the engine is started.

2. Description of the Related Art

Among recoil starters designed to transmit a rotation of a rope reel, rotated by pulling a recoil rope, to a cam and further rotate a rotational member such as flywheel magnet or drive pulley via a centrifugal clutch or other ratchet mechanism which engages with or disengages from the cam, a recoil starter has been proposed which is constructed to absorb a shock, caused due to fluctuations in load during engine startup and transmitted to an operator's hand, by resiliently coupling the rope reel and the cam through a damper spring in the form of a coil spring to transmit a rotation of the rope reel to the cam via the damper spring.

In the proposed recoil starter, as shown in FIG. 8, a damper spring 34 is received within annular recesses 32 and 33 which are formed on opposing surfaces of a rope reel 30 and a cam 31 while one end portion 35 thereof bent in U shape is fitted within a holding groove 36 formed on the rope reel 30 and the other end portion 37 thereof, bent in an axial direction, is inserted into an opening 38 formed in the cam 31, so that the rope reel 30 and the cam 31 are rotationally coupled to each other via the damper spring 34. When a rope 39 wound around the rope reel 30 is pulled to rotate the rope reel 30, the cam 31 is rotated via the damper spring 34. As a result, engagement of cam pawls 40 formed on the outer peripheral surface of the cam 31 with a ratchet 42 provided on a rotational member 41 attached to a crankshaft of an engine allows a rotation of the cam 31 to be transmitted to the rotational member 41, whereby the crankshaft coupled to the rotational member 41 is rotated. When the rotation of the cam 31 is precluded by a startup resistance of the engine, the damper spring 34 is twisted, so that a shock on the rope reel 30 is cushioned and a rotational force of the rope reel 30 is stored in the damper spring 34. When a driving force of the rope reel 30 exceeds the startup resistance of the engine, the rotational force stored in the damper spring 34 is released, so that the rotational member 41 is rotated via the cam 31 to start the engine (e.g., Japanese Patent Application No. 2002-144695).

In the proposed recoil starter, the opposite end portions 35 and 37 of the damper spring 34 are held on the rope reel 30 and the cam 31 in a fixed manner, respectively. Thus, the end portions 35 and 37 of the damper spring 34 cannot radially move. Therefore, although a middle part of a coiled portion of the damper spring 34 winds and tightens around the outer peripheral surfaces of bosses 43 and 44 of the rope reel 30 and the cam 31, opposite ends of the coiled portion are deformed to the extent that the ends are detached from the outer peripheral surfaces of the bosses 43 and 44 as shown in FIG. 8. Under such a condition, the bent portions at the opposite ends of the damper spring 34 undergo an excessive stress, possibly resulting in breakage of the damper spring 34.

A technique has been proposed which restricts the relative rotational angle between the rope reel 30 and the cam 31 by stopper means arranged between the rope reel 30 and the cam 31 to keep load on the damper spring 34 below a predetermined setting. In this technique, however, when the stopper means operates, a feel of collision is caused and transmitted as a shock to the operator's hand pulling the recoil rope 39, resulting in an unpleasant feel during startup. Further, since the cam 31 is simply supported at its central portion by a shaft 46 formed on a casing 45 so as to be rotatable, when a spring force of the damper spring 34 acts on the cam 31 while only one of the ratchets 42 is engaged with the cam pawl 40, an eccentric load or a strong leaning force acts on the cam 31, possibly resulting in breakage of the cam 31.

Further, it is desirable that the damper spring 34 have greater shock-absorbing and force-storing capabilities. While these capabilities can be enhanced by increasing a wire diameter and a winding diameter of the damper spring 34, the sizes of the annular recesses 32 and 33 receiving the damper spring 34 must be increased in outer diameter thereof corresponding to the increase of the wire diameter and winding diameter of the damper spring 34. In the proposed technique, the cam pawls 40 are formed such that the cam pawls 40 protrude outwardly from the outer surface of an outer peripheral wall 47 of the annular recess 33 formed on the cam 31 to receive therein the damper spring 34, as shown in FIGS. 9A and 9B. Therefore, the outer size of the cam 31 is restricted in relation to such parts as the ratchet 42, a cooling fan formed on the rotational member 41, the casing 45 and the like. Consequently, since the size of the annular recess 33 is thus restricted, it is difficult to increase the wire diameter and winding diameter of the damper spring 34 unless the overall size of the recoil starter is scaled up.

SUMMARY OF THE INVENTION

The present invention has been made in order to solve the problems associated with the related techniques.

It is therefore an object of the present invention to provide a recoil starter having enhanced durability by improving durability of a damper spring incorporated therein through inhibiting excessive deformation of the damper spring.

It is another object of the present invention to provide a recoil starter capable of receiving a damper spring with high shock-absorbing and force-storing capabilities without scaling up the overall outer dimensions thereof.

It is a further object of the present invention to provide a recoil starter having enhanced durability by improving durability of a cam incorporated therein through inhibiting an eccentric load on the cam.

In accordance with an aspect of the present invention, there is provided a recoil starter. The recoil starter comprises: a casing having a reel shaft formed on an inside thereof; a rope reel rotatably mounted to the reel shaft and having a recoil rope wound therearound; a spiral spring for rotationally urging the rope reel in a direction of winding the recoil rope; a cam rotatably mounted to the reel shaft in a manner to face the rope reel; a rotational member attached to a crankshaft of an engine and provided with a ratchet mechanism which disengageably engages with the cam; and a damper spring in the form of a coil spring disposed around outer peripheries of bosses which are formed on the rope reel and the cam, respectively, the damper spring having opposite ends held respectively on the rope reel and the cam, wherein a rotational force of the rope reel is transmitted to the cam via a resilience of the damper spring and a rotation of the cam is then transmitted to the rotational member via the ratchet mechanism to thereby start the engine, wherein the opposite ends of the damper spring are provided with respective engaging portions which are radially movably supported by holding portions on the rope reel and the cam, respectively, so that when the damper spring is resiliently deformed by a startup resistance of the engine, substantially the overall length of a coiled portion of the damper spring winds and tightens uniformly around the outer peripheral surfaces of both of the bosses formed on the rope reel and the cam, respectively.

In a preferred embodiment of the present invention, the bosses are extended from and integrally formed on the rope reel and the cam, respectively, and include respective end faces which are butted against each other substantially at the middle of the coiled portion of the damper spring.

In a preferred embodiment of the present invention, the cam is rotatably supported at two locations, one of the locations being a center support portion defined by an end face of the reel shaft and the other being an outer peripheral support portion defined by an outer peripheral surface of a flange portion which is radially outwardly protruded and integrally formed on the cam so as to engage with the side surface of the rope reel.

In a preferred embodiment of the present invention, the rope reel and the cam are provided on joining surfaces thereof with respective annular recesses which are formed to face each other so as to receive the damper spring therein, the rope reel and the cam being coupled together via the damper spring; and the cam includes an outer peripheral wall which forms the annular recess thereof and on which a plurality of openings are formed circumferentially apart so that portions of the outer peripheral wall between the adjacent openings each define a cam pawl which is engageable with the ratchet mechanism.

In a preferred embodiment of the present invention, the outer peripheral wall of the cam forming the annular recess thereof is provided on one side thereof with a flange portion which is radially outwardly extended and integrally formed on the outer peripheral wall, and wherein each of the cam pawls has opposite ends thereof connected to and supported by an inner peripheral rim of the flange portion and a bottom of the annular recess of the cam, respectively.

In accordance with another aspect of the present invention, there is provided a recoil starter which comprises: a casing having a reel shaft formed on an inside thereof; a rope reel rotatably mounted to the reel shaft and having a recoil rope wound therearound; a spiral spring for rotationally urging the rope reel in a direction of winding the recoil rope; a cam rotatably mounted to the reel shaft in a manner to face the rope reel; a rotational member attached to a crankshaft of an engine and provided with a ratchet mechanism which disengageably engages with the cam; and a damper spring interposed between the rope reel and the cam, wherein a rotational force of the rope reel is transmitted to the cam via a resilience of the damper spring and a rotation of the cam is then transmitted to the rotational member via the ratchet mechanism to thereby start the engine, wherein the rope reel and the cam are provided on joining surfaces thereof with respective annular recesses which are formed to face each other so as to receive the damper spring therein, the damper spring having opposite ends thereof held respectively onto the rope reel and the cam so that the rope reel and the cam are coupled together via the damper spring; and the cam includes an outer peripheral wall which forms the annular recess thereof and on which a plurality of openings are formed circumferentially apart so that portions of the outer peripheral wall between the adjacent openings each define a cam pawl which is engageable with the ratchet mechanism.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE INVENTION

Figure 1:
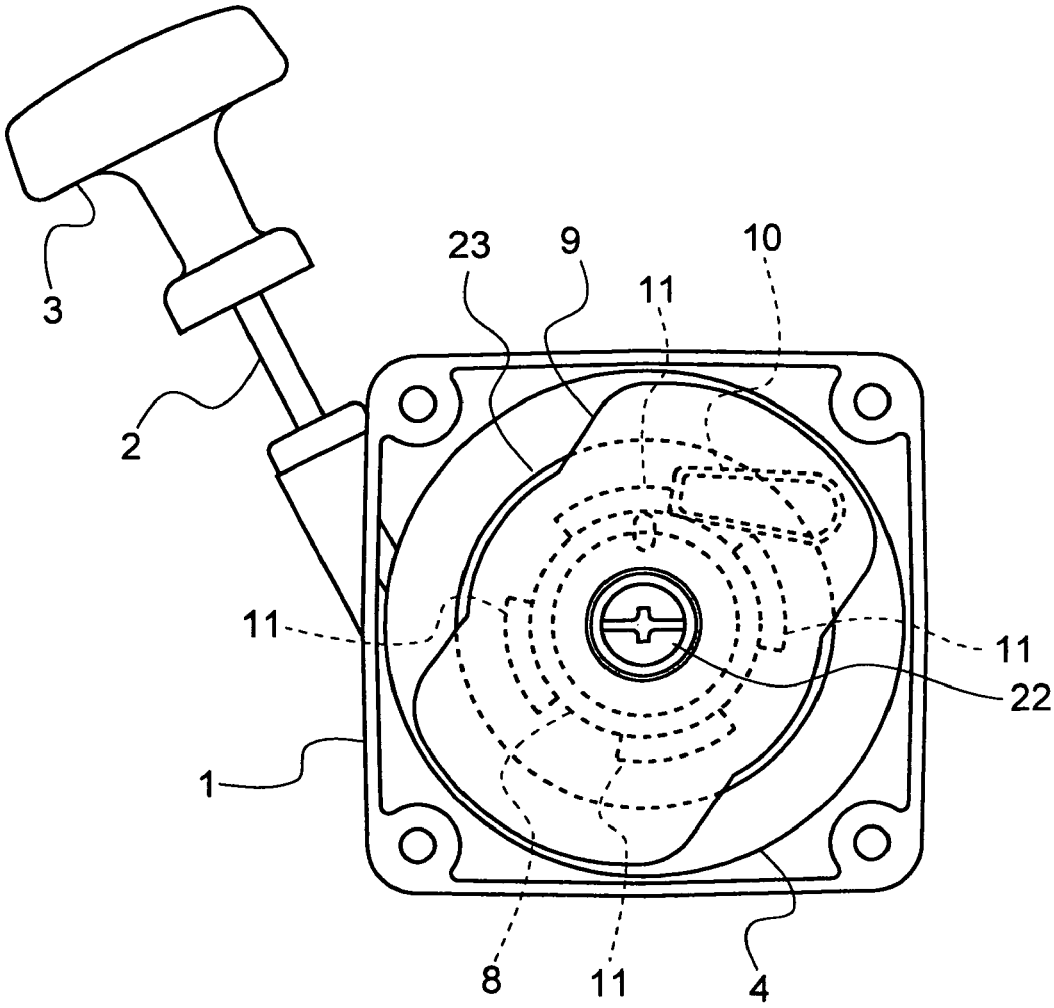
FIG. 1 is a front view illustrating a recoil starter according to an embodiment of the present invention.

A preferred embodiment of the present invention will now be described with reference to the drawings. A recoil starter according to the embodiment of the present invention, as shown in FIG. 1, is constructed such that when a handle 3 which is joined to one end of a recoil rope 2 exposed outside a casing 1 is pulled, a rope reel 4 received within the casing 1 is rotationally driven and thus a cam 8 is rotated by the rope reel 4, so that a rotational member 9 coupled to a crankshaft of an engine via a ratchet mechanism 10 which is engageable with cam pawls 11 formed on an outer peripheral surface of the cam 8, to thereby start the engine.

Figure 2:
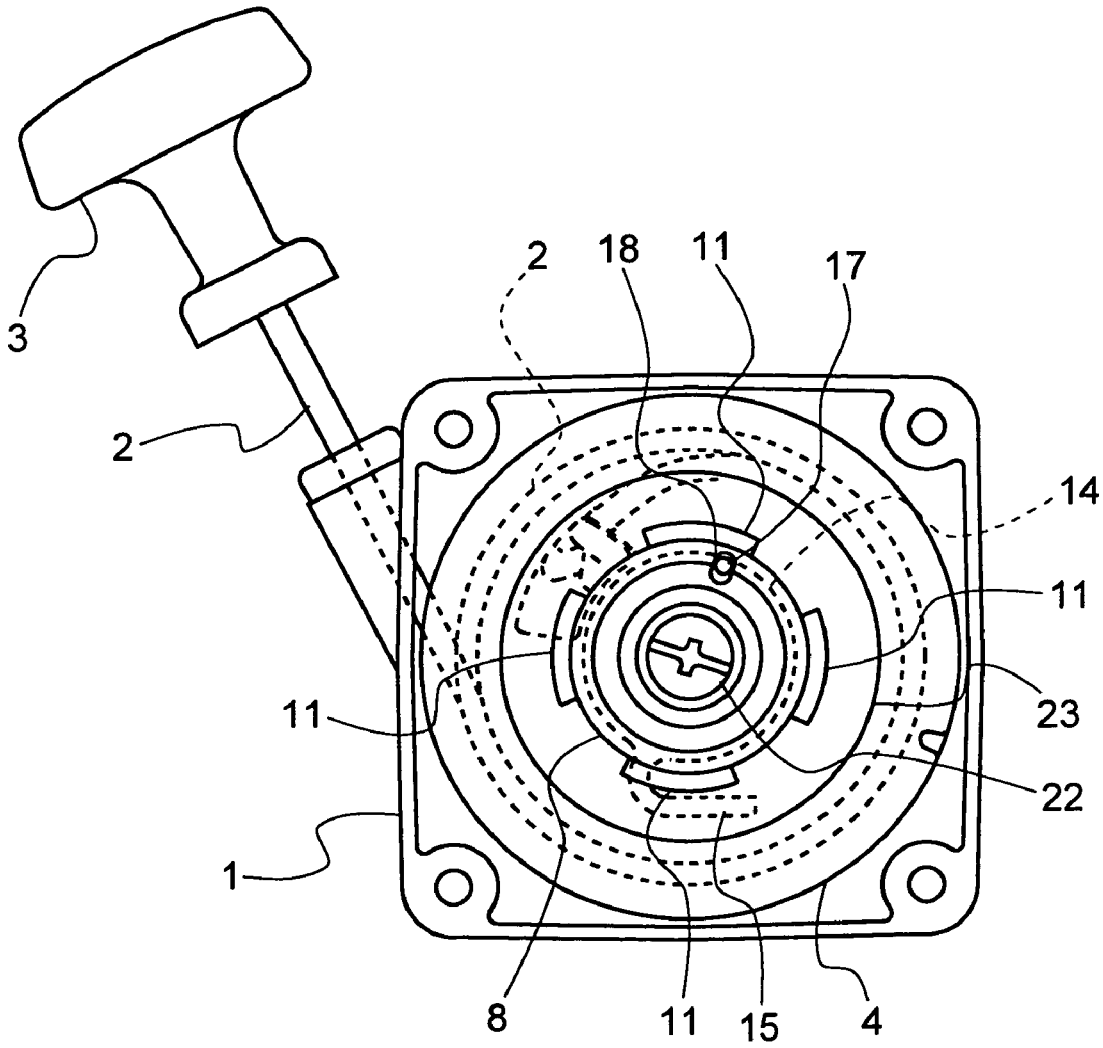
FIG. 2 is a front view illustrating the recoil starter shown in FIG. 1 with a rotational member removed.
Figure 3:
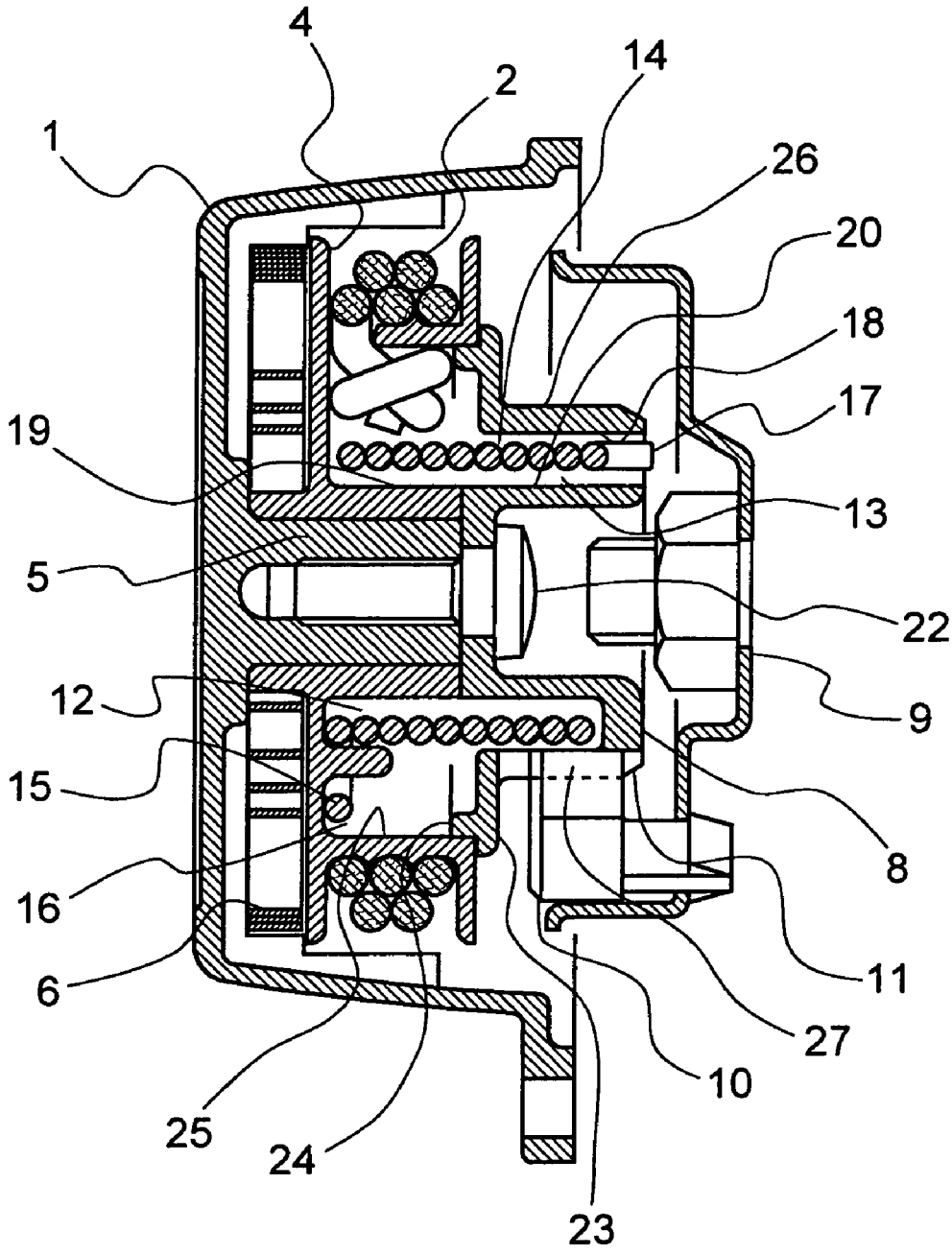
FIG. 3 is a sectional side elevation view of the recoil starter shown in FIG. 1.

As shown in FIGS. 2 and 3, the rope reel 4 has the recoil rope 2 wound therearound, of which the one end is drawn outside the casing 1, and is rotatably supported by a reel shaft 5 which is integrally formed on an inside of the casing 1 in a manner to be protruded inwardly in the casing 1. The other end of the recoil rope 2 wound around the rope reel 4 is fixed to the rope reel 4. The one end of the recoil rope 2 is drawn outside the casing 1 and has the handle 3 joined to the extremity thereof to manually pull the recoil rope 2. Pulling the handle 3 unwinds a wound portion of the recoil rope 2 from the rope reel 4 to rotate the rope reel 4 about the reel shaft 5.

A recoil spiral spring 6 is provided between a side surface of the rope reel 4 and an inner wall surface of the casing 1 so as to rotate the rope reel 4, which has been rotated by pulling of the recoil rope 2, in reverse, to thereby rewind the recoil rope 2 onto the rope reel 4. One end at an inner peripheral side of the recoil spiral spring 6 is fixed to the casing 1 while the other end at an outer peripheral side thereof is fixed to the rope reel 4. As the rope reel 4 is rotated by pulling the recoil rope 2, a rotational force is stored in the recoil spiral spring 6. When the recoil rope 2 is released, the rotational force stored in the recoil spiral spring 6 rotates the rope reel 4 in reverse, resulting in the recoil rope 2 being wound onto the rope reel 4.

The cam 8 is mounted, adjacently to the rope reel 4, by a screw 22, to an end face of the reel shaft 5 formed on the casing 1 so as to be rotatable, so that the cam 8 transmits a rotation of the rope reel 4 to the crankshaft of the engine. A plurality of the cam pawls 11 are formed on the outer periphery of the cam 8 so that the cam pawls 11 are disengageably engaged with the ratchet mechanism 10 provided on the rotational member 9 which is coupled to the crankshaft of the engine. When one of the cam pawls 11 is engaged with the ratchet mechanism 10 of the rotational member 9, a rotation of the cam 8 is transmitted to the crankshaft of the engine via the rotational member 9. In the illustrated embodiment, the ratchet mechanism 10 is constructed as a centrifugal clutch, so that due to a rotation of the rotational member 9 after startup of the engine, the ratchet mechanism 10 is rotationally moved in a direction of disengaging from the cam pawls 11 by a centrifugal force. As a result, transmission of rotation between the engine side and the cam 8 is interrupted, to thereby prevent transmission of rotation from the engine side to the recoil starter side.

Figure 4:
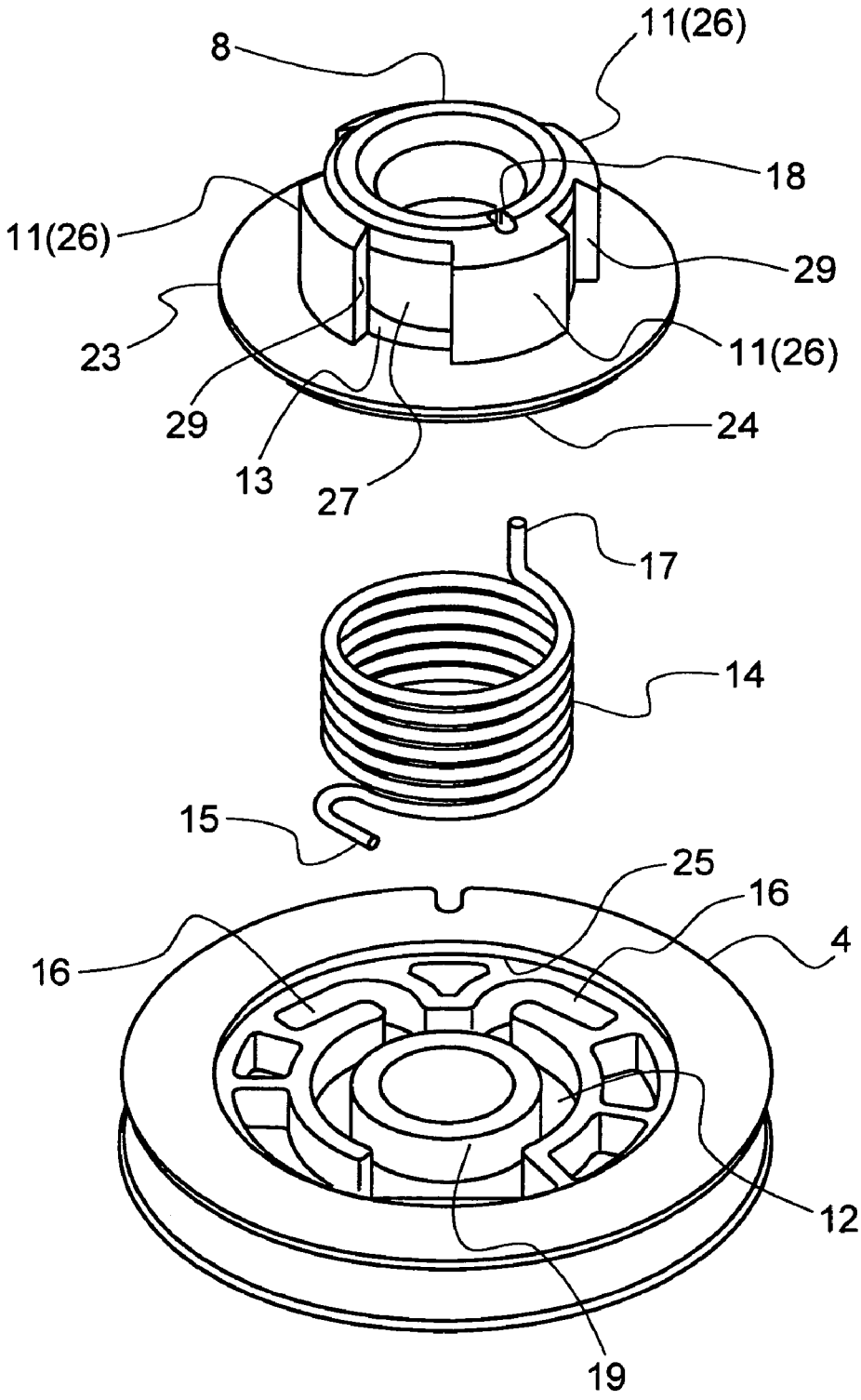
FIG. 4 is an exploded perspective view showing a rope reel, a damper spring and a cam used in the embodiment of FIG. 1.

Annular recesses 12 and 13 are formed respectively on opposing side surfaces of the rope reel 4 and the cam 8 such that the annular recesses 12 and 13 are opposite to each other. The annular recesses 12 and 13 receive a damper spring 14 therein which rotationally couples the rope reel 4 and the cam 8. As shown in FIG. 4, the damper spring 14 is configured in the form of a torsion coil spring, and has an engaging portion 15 at one end thereof, which engaging portion is formed by bending one end portion of the damper spring 14 horizontally into a U shape. The engaging portion 15 is received within one of holding grooves 16 which are formed on the outside of the annular recess 12 of the rope reel 4 to be contiguous to the annular recess 12, with a result that the rope reel 4 and the annular recess 12 are rotationally coupled together. Another engaging portion 17, bent in an axial direction, is formed on the other end of the damper spring 14. The engaging portion 17 is inserted in a holding hole 18 which penetrates from a bottom 28 of the annular recess 13 to a top side of the cam 8, so that the other end of the damper spring 14 is rotationally coupled to the cam 8.

The annular recesses 12 and 13 of the rope reel 4 and the cam 8 include respective inner peripheral surfaces which form bosses 19 and 20 having the same outer diameter. The damper spring 14 is disposed such that end faces of the bosses 19 and 20 are butted against each other substantially at the middle of the coiled portion of the damper spring 14 received within the annular recesses 12 and 13. Such construction allows the coiled portion of the damper spring 14 to wind and tighten substantially uniformly around outer peripheral surfaces of the respective bosses 19 and 20 of the rope reel 4 and the cam 8 when a predetermined rotational force is stored in the damper spring 14 by a startup resistance of the engine, with a result that a further elastic deformation of the damper spring 14 is inhibited and a maximum stress is limited.

Figure 7:
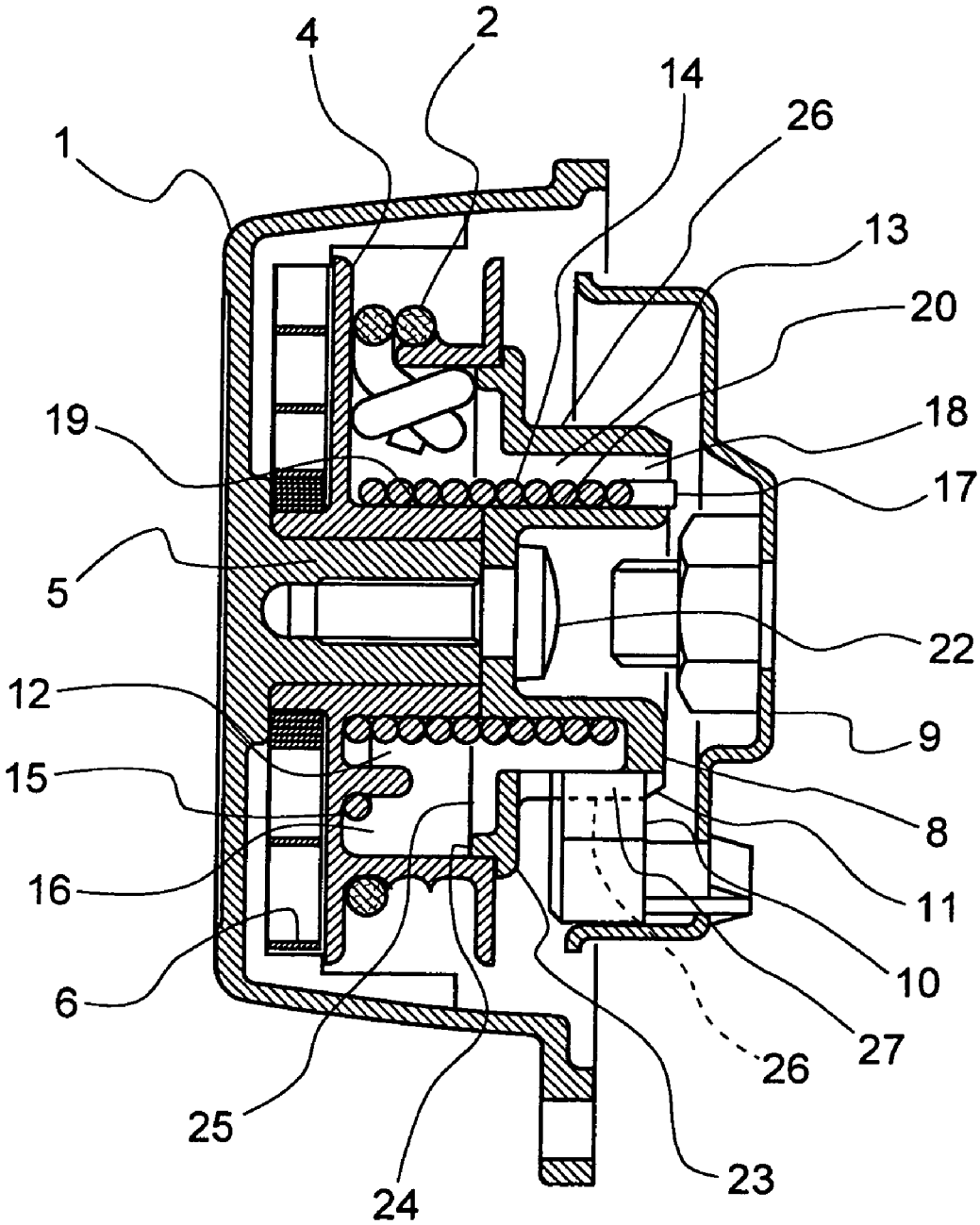
FIG. 7 is a sectional side elevation view of the recoil starter shown in FIG. 3 wherein the damper spring is tightly wound.
Figure 8:
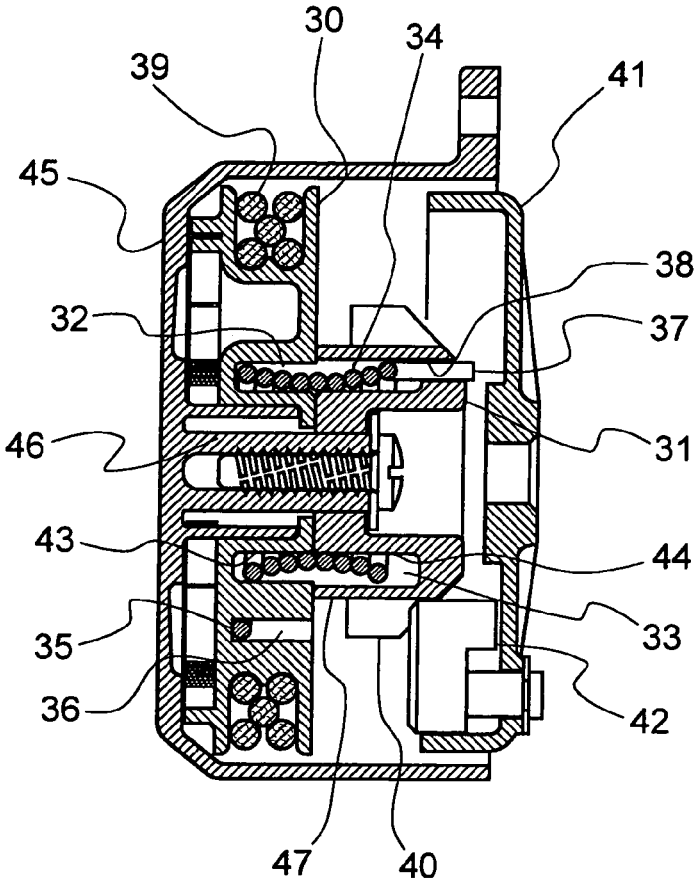
FIG. 8 is a sectional side elevation view illustrating a recoil starter in the related art in a state where a damper spring is subjected to an excessive stress.
Figure 9A:
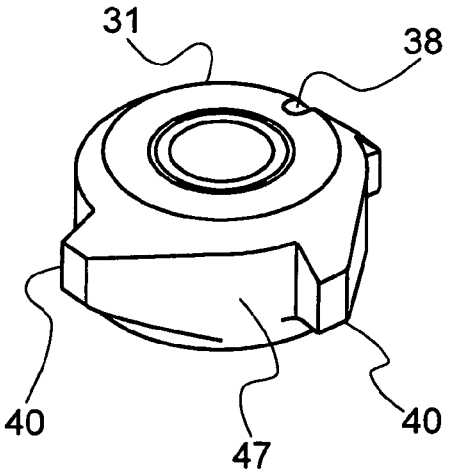
FIG. 9A is a perspective view illustrating a cam employed in the recoil starter shown in FIG. 8
Figure 9B:
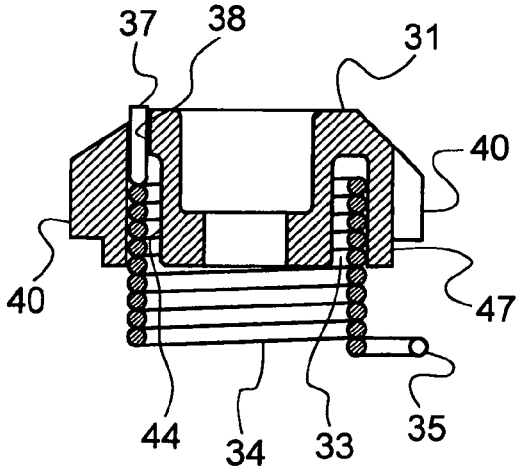
FIG. 9B is a longitudinal sectional side view of the cam which has the damper spring received therein.

As shown in FIGS. 3 and 4, the engaging portion 15 of the damper spring 14 held by the rope reel 4 is received within the holding groove 16 and held such that the engaging portion 15 can move toward and away from the outer peripheral surface of the boss 19 of the annular recess 12 of the rope reel 4. The holding hole 18 formed at the bottom 28 of the annular recess 13 of the cam 8 is formed to be elongated in a radial direction of the cam 8. The engaging portion 17 at the other end of the damper spring 14 is loosely fitted into the holding hole 18 so as to allow the engaging portion 17 to approach the outer peripheral surface of the boss 20 of the cam 8. Such construction allows the overall length of the coiled portion of the damper spring 14 to uniformly wind and tighten around the bosses 19 and 20 as shown in FIG. 7 when the coiled portion of the damper spring 14 winds and tightens around the bosses 19 and 20. Such function is the same as that of a mechanism of a publicly known spring clutch. The coiled portion of the damper spring 14 functions as a spring clutch as the coiled portion winds and tightens around the bosses 19 and 20 of the rope reel 4 and the cam 8, resulting in the bosses 19 and 20 being rotationally coupled together.

Figure 5:
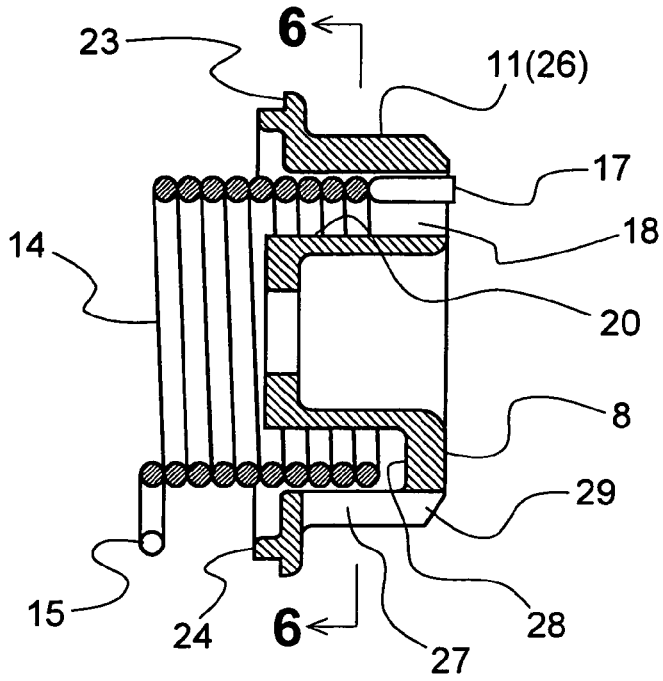
FIG. 5 is a sectional side elevation view of the cam shown in FIG. 4 which has the damper spring received therein.
Figure 6:
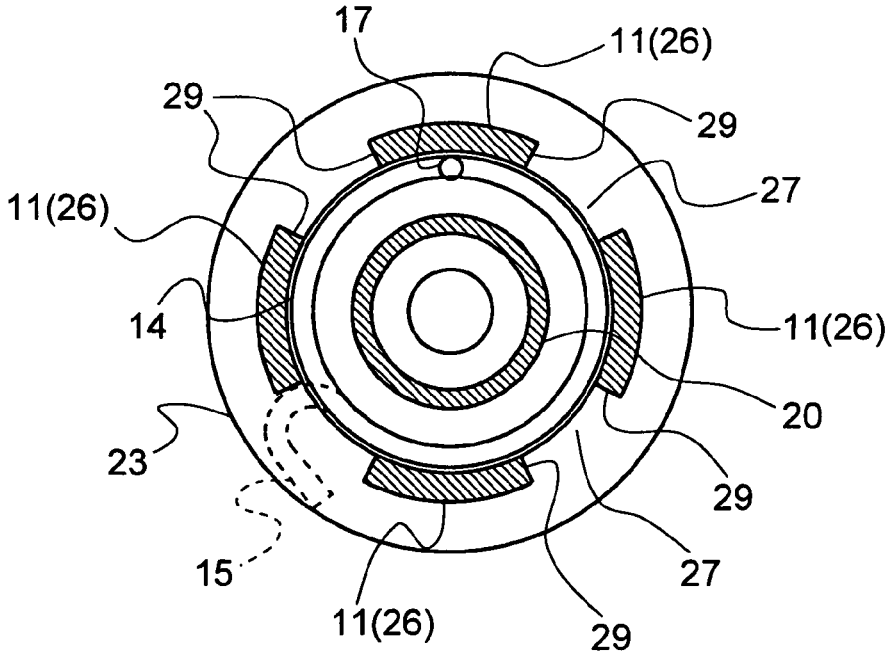
FIG. 6 is a sectional view taken along line 6—6 of FIG. 5.

As shown in FIGS. 4 to 6, the outer peripheral wall 26 of the cam 8 which forms the annular recess 13 is provided with a flange portion 23 which is radially outwardly extended and integrally formed on one side of the outer peripheral wall 26. A plurality of openings 27 are formed circumferentially apart from one another by removing portions of the outer peripheral wall 26 of the cam 8 at a plurality of locations such that the openings 27 penetrate from the inside of the annular recess 13 to the outside of the outer peripheral wall 26. The un-removed portions of the outer peripheral wall 26 between the adjacent openings 27 form the respective cam pawls 11 which are distributed in a circumferential direction. The outer peripheral wall 26 forming the cam pawls 11 have opposite ends connected by an inner peripheral rim of the flange portion 23 and the bottom 28 of the annular recess 13. This allows the damper spring 14 to be received within and supported by the inner peripheral surfaces of the cam pawls 11 and allows engagement surfaces 29 of the cam pawls 11 facing in the circumferential direction to engage with the ratchet mechanism 10, whereby the rotation of the cam 8 is transmitted to the rotational member 9 via the ratchet mechanism 10.

Further, the engagement surfaces 29 engageable with the ratchet mechanism 10 are formed on opposite circumferential ends of each of the cam pawls 11 of the cam 8 in a manner to extend in a direction perpendicular to the circumferential direction, as shown in FIGS. 5 and 6. In addition, the holding grooves 16, which are formed in association with the annular recess 12 of the rope reel 4 so as to fit therein the engaging portion 15 of the damper spring 14 received in the annular recess 12, are formed symmetrically in the circumferential direction as shown in FIG. 4 such that the holding grooves 16 allow either of damper springs with different winding directions to be fitted therein, resulting in the recoil starter being applicable to both of an engine running in a certain rotational direction and an engine running in an opposite rotational direction.

In addition, the flange portion 23 of the cam 8 is provided at an outer peripheral side of the side surface thereof with an annular guide 24 which is integrally formed on the flange portion 23 so as to protrude toward the rope reel 4, as shown in FIG. 4. The circular guide 24 is fitted within an annular recessed portion 25 which is formed on the side surface of the rope reel 4 so as to guide relative rotation between the cam 8 and the rope reel 4. The cam 8 and the rope reel 4 are incorporated into the casing 1 in the following manner. First, the rope reel 4 is mounted to the reel shaft 5 formed on the casing 1. Then, the damper spring 14 is attached to the boss 19 of the rope reel 4 while the engaging portion 15 of one end of the damper spring 14 is fitted within the holding groove 16 of the rope reel 4. Thereafter, the cam 8 is placed on the side surface of the rope reel 4 such that the engaging portion 17 at the other end of the damper spring 14 is inserted into the holding hole 18 formed on the cam 8, and then the screw 22 is fastened to the distal end of the reel shaft 5.

The cam 8 is supported at its center by a proximal portion of the screw 22 so as to be rotatable with respect to the reel shaft 5 and also supported at the annular guide 24 on the outer peripheral side of the flange portion 23 by the annular recessed portion 25 of the rope reel 4 so as to be rotatable, so that inclination of the cam 8 due to an eccentric load acting on the cam 8 can be inhibited and breakage of the cam 8 due to the eccentric load can be prevented. In the illustrated embodiment, the annular guide 24 is formed on the flange portion 23 of the cam 8. However, the same effect can be obtained by forming an annular guide such that the guide protrudes from the rope reel 4 toward the cam 8 and by engaging an outer peripheral edge of the flange portion 23 of the cam 8 with an inner peripheral surface of the annular guide of the rope reel 4.

Now, the operation of the recoil starter of the embodiment will be described. Prior to engine startup operations, the ratchet mechanism 10, provided on the rotational member 9 which is coupled to the crankshaft of the engine, is retracted due to the action of a spring (not shown) and is located at an inner side position where the ratchet mechanism 10 is to come into contact with the cam pawls 11 formed on the cam 8. When the recoil rope 2 is pulled to rotate the rope reel 4, the cam 8 is caused to rotate together with the rope reel 4 via the damper spring 14. The cam pawl 11 of the cam 8 is brought into contact with the ratchet mechanism 10, to thereby rotate the rotational member 9 via the ratchet mechanism 10 and also rotate the crankshaft of the engine coupled to the rotational member 9. At this time, although a rotational load of the cam 8 increases due to an increase in rotational load resulting from a startup resistance of the engine, the damper spring 14 is twisted to absorb the load, whereby a shock is prevented from being directly transmitted to the recoil rope 2.

At this time, twisting of the damper spring 14 results in a rotational force of the rope reel 4 being stored in the damper spring 14. As the damper spring 14 is twisted, the diameter of the coiled portion thereof diminishes, so that the coiled portion thereof is caused to wind and tighten around the bosses 19 and 20 of the rope reel 4 and the cam 8, with the result that no more stress acts on the damper spring 14. Under this condition, the rope reel 4 and the cam 8 are coupled together as an integral part by the action of the damper spring 14 like a spring clutch, so that a rotation of the rope reel 4 is directly transmitted to the cam 8. At this time, since the engaging portions 15 and 17 at the opposite ends of the damper spring 14 are moved inwardly, substantially the overall length of the coiled portion of the damper spring 14 comes into a close contact with the outer peripheral surfaces of the bosses 19 and 20, with the result that the end portions of the damper spring 14 are not subjected to an excessive stress.

At this time, an eccentric load acts on the cam 8 between the cam pawl 11 engaged with the ratchet mechanism 10 and the holding hole 18 supporting the damper spring 14. However, the cam 8 is supported at its center by the screw 22 and supported at the annular guide 24 on the outer peripheral side of the flange portion 23 by the peripheral surface of the annular recessed portion 25 of the rope reel 4, thus inhibiting inclination and deformation of the cam 8 due to the eccentric load.

Further, when the rotational force exceeds the startup resistance of the engine as the rope reel 4 is rotated, the rotational force of the rope reel 4 by pulling the recoil rope 2 and the rotational force stored in the damper spring 14 are released to the cam 8, so that the rotational force is transmitted to the rotational member 9 via the ratchet mechanism 10. As a result, the crankshaft of the engine is caused to be rotated abruptly, to thereby start the engine. When the engine starts and the crankshaft rotates, the ratchet mechanism 10 moves rotationally outwardly due to the action of centrifugal force, so that the ratchet mechanism 10 disengages from the cam pawl 11 of the cam 8 to prevent a rotation of the engine from being transmitted to the cam pawls 11. When the recoil rope 2 is loosened after startup of the engine, the rope reel 4 is rotated in the reverse direction by the rotational force stored in the recoil spiral spring 6, whereby the recoil rope 2 is wound onto the rope reel 4.

As described above, according to the invention, when an excessive load occurs on the engine side, the damper spring winds and tightens around the outer peripheral surfaces of the bosses formed on the rope reel and the cam, so that substantial deformation of the damper spring due to the excessive load is inhibited. Therefore, a decrease in durability of the damper spring due to the excessive load can be prevented. Moreover, according to the present invention, the coiled portion of the damper spring rotationally couples the rope reel and the cam together as an integral part by gradually winding and tightening around the bosses, thus giving no feel of collision unlike the stopper in the related art described above and providing an improved feel during engine startup operations performed by pulling the recoil rope.

Further, since the engaging portions at the opposite ends of the damper spring are supported so as to move toward and away from the outer peripheral surfaces of the bosses, substantially the overall length of the coiled portion of the damper spring winds around the bosses and rotationally couples the rope reel and the cam as an integral part due to the action of the spring clutch. This maintains a stress which is generated at the engaging portions at the opposite ends of the damper spring low, thus extending the durability of the damper spring.

In one embodiment of the invention, since the end faces of the bosses formed on the rope reel and the cam are butted substantially at the middle of the coiled portion of the damper spring, the coiled portion of the damper spring winds and tightens uniformly around the outer peripheral surfaces of both of the bosses, thus rotationally coupling the rope reel and the cam together due to the action of the spring clutch. Such construction permits a rotational force from the rope reel to be transmitted to the cam without any excessive stress taking place on the damper spring.

In one embodiment of the invention, since the cam is supported at two points, one at the center and the other at the outer periphery, by the screw and the flange portion so as to be rotatable, the cam is more resistant to being inclined and displaced due to an eccentric load. As a result, in a case where only one of the two ratchet mechanisms engages with the cam pawl or in a case where there is provided only one ratchet mechanism, inclination of the cam by a heavy eccentric load can be prevented, thus keeping the cam intact.

In one embodiment of the present invention, the outer peripheral wall of the annular recess formed on the cam to receive the damper spring is partially removed to form the openings, so that the un-removed remaining portions of the wall form the cam pawls. Therefore, there is no need to form the cam pawls protruding outwardly from the outer peripheral wall of the cam, so that it is possible to enlarge the outer peripheral wall of the annular recess outwardly by as much as the protruded cam pawls which would otherwise be formed. As a result, it is possible to increase the outer diameter of the annular recess without increasing the outer size of the cam, thus allowing the damper spring with a larger wire diameter and a winding diameter to be received in the annular recess. Therefore, it is possible to accommodate the damper spring having high shock-absorbing and force-storing capabilities without increasing the outer size of the recoil starter, thus providing an easy-to-operate recoil starter.

In a case where the damper spring having a size identical to that of the conventional one is used, the outer size of the cam can be reduced, so that the rotational member such as a flywheel magnet, a drive pulley or the like provided on the outside of the cam and the casing containing these parts can be designed to have a reduced size, to thereby provide a compact and lightweight recoil starter.

In one embodiment of the invention, the outer peripheral wall of the cam forming the annular recess thereof is provided on one end thereof with the flange portion which is radially outwardly extended and integrally formed on the peripheral wall such that each of the cam pawls has opposite ends thereof connected to and supported by the inner peripheral rim of the flange portion and the bottom of the annular recess, respectively. Such construction can prevent deformation of the cam pawls when the cam pawls are engaged with the ratchet mechanism.

While an illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A recoil starter comprising:

a casing having a reel shaft formed on an inside thereof;

a rope reel rotatably mounted to said reel shaft and having a recoil rope wound therearound;

a spiral spring for rotationally urging said rope reel in a direction of winding said recoil rope;

a cam rotatably mounted to said reel shaft in a manner to face said rope reel;

a rotational member attached to a crankshaft of an engine and provided with a ratchet mechanism which disengageably engages with said cam; and a damper spring in the form of a coil spring disposed around outer peripheries of bosses which are formed on said rope reel and said cam, respectively, said damper spring having opposite ends held respectively on said rope reel and said cam, wherein a rotational force of said rope reel is transmitted to said cam via a resilience of said damper spring and a rotation of said cam is then transmitted to said rotational member via said ratchet mechanism to thereby start the engine, wherein said opposite ends of said damper spring are provided with respective engaging portions which are radially movably supported by holding portions on said rope reel and said cam, respectively, so that when said damper spring is resiliently deformed by a startup resistance of the engine, substantially the overall length of a coiled portion of said damper spring winds and tightens uniformly around the outer peripheral surfaces of both of said bosses formed on said rope reel and said cam, respectively.

2. The recoil starter according to claim 1, wherein said bosses are extended from and integrally formed on said rope reel and said cam, respectively, and include respective end faces which are butted against each other substantially at the middle of said coiled portion of said damper spring.

3. The recoil starter according to claim 1, wherein said cam is rotatably supported at two locations, one of the locations being a center support portion defined by an end face of said reel shaft and the other being an outer peripheral support portion defined by an outer peripheral surface of a flange portion which is radially outwardly protruded and integrally formed on said cam so as to engage with the side surface of said rope reel.

4. The recoil starter according to claim 2, wherein said cam is rotatably supported at two locations, one of the locations being a center support portion defined by an end face of said reel shaft and the other being an outer peripheral support portion defined by an outer peripheral surface of a flange portion which is radially outwardly protruded and integrally formed on said cam so as to engage with the side surface of said rope reel.

5. The recoil starter according to claim 1, wherein said rope reel and said cam are provided on joining surfaces thereof with respective annular recesses which are formed to face each other so as to receive said damper spring therein, said rope reel and said cam being coupled together via said damper spring; and said cam includes an outer peripheral wall which forms said annular recess thereof and on which a plurality of openings are formed circumferentially apart so that portions of said outer peripheral wall between the adjacent openings each define a cam pawl which is engageable with said ratchet mechanism.

6. The recoil starter according to claim 2, wherein said rope reel and said cam are provided on joining surfaces thereof with respective annular recesses which are formed to face each other so as to receive said damper spring therein, said rope reel and said cam being coupled together via said damper spring; and said cam includes an outer peripheral wall which forms said annular recess thereof and on which a plurality of openings are formed circumferentially apart so that portions of said outer peripheral wall between the adjacent openings each define a cam pawl which is engageable with said ratchet mechanism.

7. The recoil starter according to claim 3, wherein said rope reel and said cam are provided on joining surfaces thereof with respective annular recesses which are formed to face each other so as to receive said damper spring therein, said rope reel and said cam being coupled together via said damper spring; and said cam includes an outer peripheral wall which forms said annular recess thereof and on which a plurality of openings are formed circumferentially apart so that portions of said outer peripheral wall between the adjacent openings each define a cam pawl which is engageable with said ratchet mechanism.

8. The recoil starter according to claim 4, wherein said rope reel and said cam are provided on joining surfaces thereof with respective annular recesses which are formed to face each other so as to receive said damper spring therein, said rope reel and said cam being coupled together via said damper spring; and said cam includes an outer peripheral wall which forms said annular recess thereof and on which a plurality of openings are formed circumferentially apart so that portions of said outer peripheral wall between the adjacent openings each define a cam pawl which is engageable with said ratchet mechanism.

9. The recoil starter according to claim 5, wherein said outer peripheral wall of said cam forming said annular recess thereof is provided on one side thereof with a flange portion which is radially outwardly extended and integrally formed on said outer peripheral wall, and wherein each of said cam pawls has opposite ends thereof connected to and supported by an inner peripheral rim of said flange portion and a bottom of said annular recess of said cam, respectively.

10. The recoil starter according to claim 6, wherein said outer peripheral wall of said cam forming said annular recess thereof is provided on one side thereof with a flange portion which is radially outwardly extended and integrally formed on said outer peripheral wall, and wherein each of said cam pawls has opposite ends thereof connected to and supported by an inner peripheral rim of said flange portion and a bottom of said annular recess of said cam, respectively.

11. The recoil starter according to claim 7, wherein said outer peripheral wall of said cam forming said annular recess thereof is provided on one side thereof with a flange portion which is radially outwardly extended and integrally formed on said outer peripheral wall, and wherein each of said cam pawls has opposite ends thereof connected to and supported by an inner peripheral rim of said flange portion and a bottom of said annular recess of said cam, respectively.

12. The recoil starter according to claim 8, wherein said outer peripheral wall of said cam forming said annular recess thereof is provided on one side thereof with a flange portion which is radially outwardly extended and integrally formed on said outer peripheral wall, and wherein each of said cam pawls has opposite ends thereof connected to and supported by an inner peripheral rim of said flange portion and a bottom of said annular recess of said cam, respectively.

13. A recoil starter comprising:

a casing having a reel shaft formed on an inside thereof;

a rope reel rotatably mounted to said reel shaft and having a recoil rope wound therearound;

a spiral spring for rotationally urging said rope reel in a direction of winding said recoil rope;

a cam rotatably mounted to said reel shaft in a manner to face said rope reel;

a rotational member attached to a crankshaft of an engine and provided with a ratchet mechanism which disengageably engages with said cam; and a damper spring interposed between said rope reel and said cam, wherein a rotational force of said rope reel is transmitted to said cam via a resilience of said damper spring and a rotation of said cam is then transmitted to said rotational member via said ratchet mechanism to thereby start the engine, wherein said rope reel and said cam are provided on joining surfaces thereof with respective annular recesses which are formed to face each other so as to receive said damper spring therein, said damper spring having opposite ends thereof held respectively onto said rope reel and said cam so that said rope reel and said cam are coupled together via said damper spring; and said cam includes an outer peripheral wall which forms said annular recess thereof and on which a plurality of openings are formed circumferentially apart so that portions of said outer peripheral wall between the adjacent openings each define a cam pawl which is engageable with said ratchet mechanism, the outer peripheral wall of the cam surrounds the damper spring and each of the plurality of openings formed in the outer peripheral wall of the cam penetrates radially from the annular recess through the outer peripheral wall of the cam.

14. The recoil starter according to claim 13, wherein said outer peripheral wall of said cam forming said annular recess thereof is provided on one side thereof with a flange portion which is radially outwardly extended and integrally formed on said outer peripheral wall, and wherein each of said cam pawls has opposite ends thereof connected to and supported by an inner peripheral rim of said flange portion and a bottom of said annular recess of said cam, respectively.

15. The recoil starter according to claim 13, wherein said cam is rotatably supported at two locations, one of the locations being a center support portion defined by an end face of said reel shaft and the other being an outer peripheral support portion defined by an outer peripheral surface of a flange portion which is radially outwardly protruded and integrally formed on said cam so as to engage with the side surface of said rope reel.

16. The recoil starter according to claim 14, wherein said cam is rotatably supported at two locations, one of the locations being a center support portion defined by an end face of said reel shaft and the other being an outer peripheral support portion defined by an outer peripheral surface of said flange portion which engages with the side surface of said rope reel.

* * * * *